US007857644B2

(12) United States Patent
Madhavan et al.

(10) Patent No.: US 7,857,644 B2
(45) Date of Patent: Dec. 28, 2010

(54) WIRED DRILL PIPE HAVING CONDUCTIVE END CONNECTIONS

(75) Inventors: Raghu Madhavan, Yokohama (JP); Qiming Li, Sugar Land, TX (US)

(73) Assignee: Intelliserv, LLC, Houston, TX (US)

( * ) Notice: Subject to any disclaimer, the term of this patent is extended or adjusted under 35 U.S.C. 154(b) by 184 days.

(21) Appl. No.: 12/237,488

(22) Filed: Sep. 25, 2008

(65) Prior Publication Data

US 2010/0071188 A1 Mar. 25, 2010

(51) Int. Cl.
*H01R 4/60* (2006.01)

(52) U.S. Cl. ..... 439/191; 439/192; 439/950

(58) Field of Classification Search ..... 439/191, 439/192, 194, 950
See application file for complete search history.

(56) References Cited

U.S. PATENT DOCUMENTS 3,696,332 A 10/1972 Dickson, Jr. et al.
5,060,737 A * 10/1991 Mohn ..... 439/194
5,339,037 A 8/1994 Bonner et al.
6,717,501 B2 4/2004 Hall et al.
6,929,493 B2 8/2005 Hall et al.
2006/0225926 A1 10/2006 Madhavan et al.

* cited by examiner

*Primary Examiner*—Tho D Ta
(74) *Attorney, Agent, or Firm*—Conley Rose, P.C.

(57) ABSTRACT

Apparatus and methods associated with wired drill pipe having conductive end connections are described. In one described example, an end connector for use with drill pipe includes a generally cylindrical body having an outer shoulder and an inner shoulder. In the described example, the outer shoulder is to engage a shoulder of a drill pipe to be coupled to the body to provide an electrically conductive connection between the body and the drill pipe, and the inner shoulder is to engage an end of the drill pipe. The example end connector also includes a generally cylindrical electrical connector rigidly coupled to the cylindrical body to form at least a portion of the inner shoulder. The generally cylindrical electrical connector is substantially electrically insulated from the cylindrical body and is to contact the end of the drill pipe to provide an electrically conductive connection between the electrical connector and the end of the drill pipe.

13 Claims, 7 Drawing Sheets

WIRED DRILL PIPE HAVING CONDUCTIVE END CONNECTIONS

FIELD OF THE DISCLOSURE

The present disclosure relates generally to wired drill pipe and, more particularly, to wired drill pipe having conductive end connections.

BACKGROUND

Reliably conveying data and/or power along a drill string has become an increasingly important aspect of wellbore drilling operations. In particular, oil companies have become increasingly reliant on the use of real-time downhole information, particularly information related to the conditions associated with the drill bit, the bottom hole assembly ("BHA"), and the formation, to improve the efficiency of their drilling operations. Such real-time downhole information is often obtained via measurement while drilling (MWD) systems and/or logging while drilling systems (LWD), both of which utilize some form of downhole telemetry system to convey data between the downhole equipment and the surface equipment.

Numerous types of telemetry systems are commonly used in connection with MWD and LWD systems. For example, mud-pulse telemetry systems use modulated pressure or acoustic waves in the drilling fluid to convey data or information between the borehole equipment (e.g., a bottom hole assembly) and the surface equipment. However, mud-pulse telemetry systems have a relatively low data transmission rate of about 0.5-12 bits/second and, thus, substantially limit the amount of information that can be conveyed in real-time and, as a result, limit the ability of an oil company to optimize their drilling operations in real-time. Other telemetry systems such as electromagnetic telemetry (EM) via subsurface earth pathways and acoustic telemetry through drill pipe have been employed. These other telemetry systems also provide a relatively low data rate that may limit the ability of an oil company to employ sophisticated real-time data processing to optimize its drilling operations.

In contrast to telemetry systems that convey data via acoustic or electromagnetic waves (e.g., EM) through a fluid or the earth itself, wired drill pipe can convey data at a relatively high rate along the length of a drill string. Some wired drill pipe designs utilize conductive electrical connections between sections of drill pipe. However, these conductive electrical connections typically employ one or more moving parts such as springs and the like to ensure a high-quality electrical connection between drill pipe sections. Such moving parts can jam or become immovable and, thus, inoperative due to caked mud, cement, as well as other wellbore debris. Other wired drill pipe designs use inductive, magnetic, or current coupling between drill pipe sections.

One example of a wired drill pipe is disclosed in U.S. Pat. No. 3,696,332, issued to Dickson, Jr., et al., which discloses a drill pipe with insulated contact rings positioned in a shoulder at both ends of the pipe. The contact rings in a single segment of pipe are connected by a conductor wire that spans the length of the pipe. When a segment of drill pipe is made up with an adjoining segment of pipe, the contact ring in the first segment of pipe makes contact with a corresponding contact in the adjacent pipe section.

U.S. Pat. No. 6,717,501, issued to Hall, et al., discloses a system for transmitting data through multiple connected downhole components. Each component includes two communication elements and a conductor that connects the two. The communications elements are located in internal shoulders.

U.S. Pat. No. 6,929,493, issued to Hall, et al., discloses an electrical contact system with a first annular conductor embedded in an insulator in a housing in a tool joint that is adapted to mate with a second electrical contact in an end of an adjacent tool joint.

SUMMARY

In one disclosed example, a pipe segment includes a generally cylindrical body having a pin end connector at a first end and a box end connector at a second, a generally cylindrical first electrical contact coupled to the cylindrical body proximate the pin end connector, wherein the first electrical contact is substantially electrically insulated from the cylindrical body and is configured to make electrical contact with a corresponding electrical contact in a first adjacent pipe segment when the pipe segment is coupled to the first adjacent pipe segment, and a generally cylindrical second electrical contact coupled to the cylindrical body proximate the box end connector, wherein the second electrical contact is substantially electrically insulated from the cylindrical body and is configured to make electrical contact with a corresponding electrical contact in a second adjacent pipe segment when the pipe segment is coupled to the second adjacent pipe segment. A first conductor is connected to the first and second electrical contacts and extending therebetween, the conductor substantially electrically insulated from the cylindrical body. The pin end connector and the box end connector may be configured to be machined without effecting the configuration of the first and second electrical contacts to make an electrical connection with electrical contacts in first and second adjacent pipe segments.

In another disclosed example, a method of forming a wired drill pipe includes coupling a generally cylindrical first electrical contact to a cylindrical body proximate a pin end connector so that an end of the first contact extends beyond a shoulder in the pin end connector, so that the first electrical contact is substantially electrically insulated from the cylindrical body. The method may also include coupling a generally cylindrical second electrical contact to the cylindrical body proximate the box end connector so that an end of the second contact extends beyond a shoulder in the box end connector, so that the second electrical contact is substantially electrically insulated from the cylindrical body. Finally, the method may include machining the first electrical contact to form a inner pin shoulder and machining the second electrical contact to form an inner box shoulder.

In another disclosed example, a method of machining a wired drill pipe includes determining a wear status of an end connector of a segment of wired drill pipe, and, if the wear status exceeds a predetermined threshold, machining the end connector to restore mechanical properties, without affecting the electrical properties of the wired drill pipe segment.

In another disclosed example, a pipe segment includes a generally cylindrical portion, a pin end connector at a first end of the generally cylindrical portion, a first electrical contact ring disposed in pin end connector, and a second electrical contact ring disposed in the pin end connector, substantially concentric with the first electrical ring. The first and second electrical contact rings are configured to make electrical contact with corresponding contact rings in an adjacent segment of pipe, when the pipe segment is connected to the adjacent pipe segment.

In another disclosed example, a pipe segment includes a tubular section, a pin end connection at a first end of the tubular section, a box end connector at a second end of the tubular section, a first contact portion, disposed in one of the pin end connector and the box end connector, the first contact portion comprising opposing semi-circular contacts that are insulated from each other, and a second contact portion, disposed in the other of the pin end connection and the box end connection, the second contact portion comprising a first electrical contact element and a second electrical contact element, where the first and second electrical contact elements are configured to make electrical contact with corresponding opposing semi-circular contacts in an end connector of an adjacent pipe segment, and wherein the first and second electrical elements are sized such that they cannot make electrical contact with both electrical contacts of the opposing semi-circular contacts in the end connector of the adjacent pipe segment.

DETAILED DESCRIPTION

Figure 1:
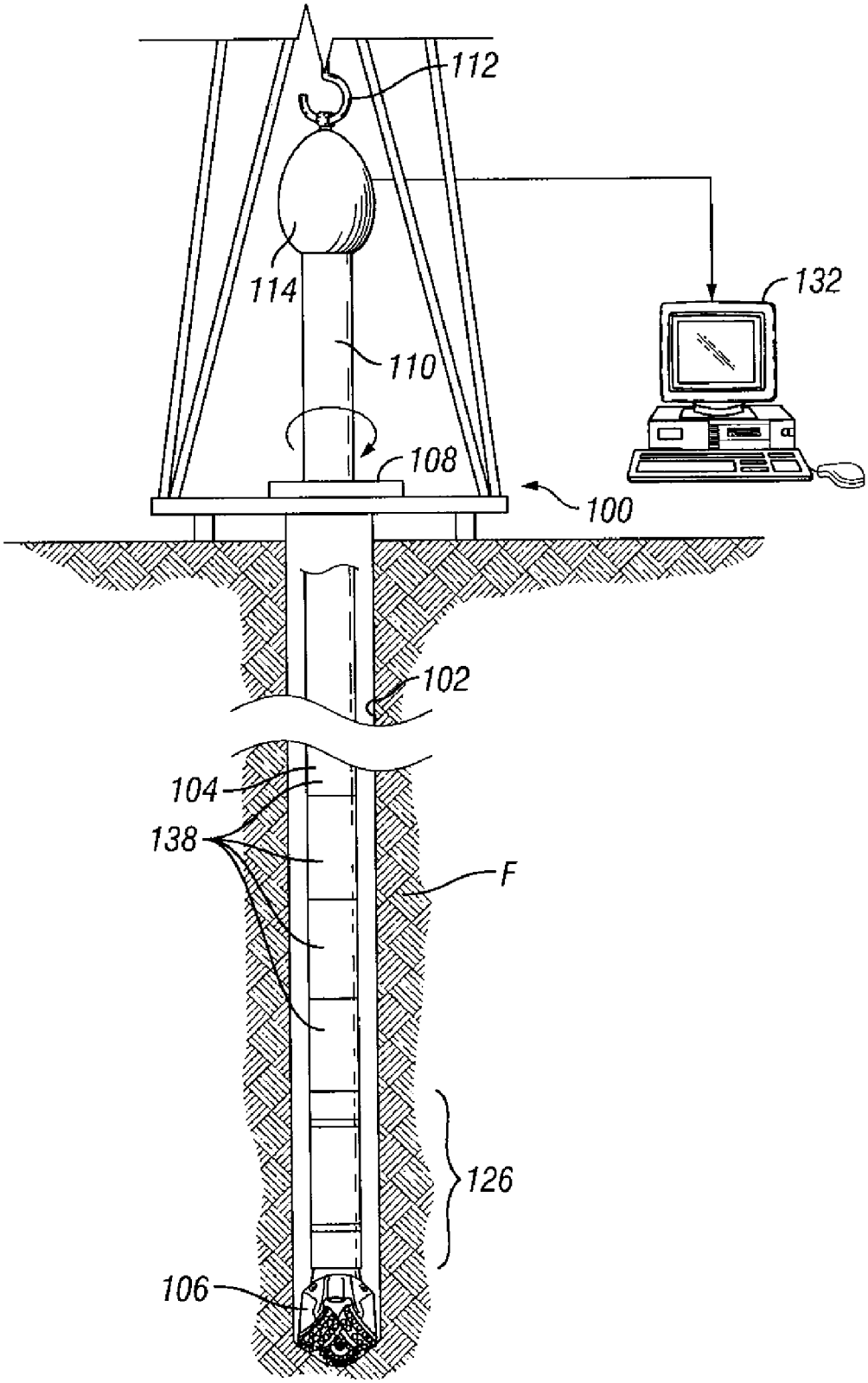
FIG. 1 depicts an example drill string that may employ the example wired drill pipe described herein.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example methods and apparatus described herein can be used to provide wired drill pipe for use in downhole drilling operations. One disclosed example employs a double-shouldered drill pipe configuration in which the pipe itself contacts the adjoining pipe to form a first electrical path along a drill string and the inner shoulders of the box and pin portions or connectors of the drill pipe sections are to contact each other directly to form a second electrical path along the drill string that is substantially electrically insulated from the first electrical path. In another disclosed example, a single-shouldered drill pipe configuration in which the pipe itself contacts the adjoining pipe to form a first electrical path along the drill string, and portions of the box and pin connectors are to contact each other to form a second electrical path. In these manners, examples of wired drill pipe may provide for dual line electrical contact and paths without any moving parts, such as springs and the like, that would otherwise be susceptible to jamming from mud, cement, etc. and/or that could otherwise become inoperable. As a result, the example wired drill pipe described herein may be used to provide high-reliability, relatively high data rate telemetry or communications along a drill string to enhance MWD operations, LWD operations, etc. In addition, in some examples, a direct electrical contact enables the transmission of DC power through the drill string. In another disclosed example, the adjoining pipe may not be needed to form an electrical path; multiple connections in portions of the box and pin connectors form two or more electrical paths.

More specifically, in one example a wired drill pipe includes a first generally cylindrical electrical connector that is substantially electrically insulated from and rigidly coupled (e.g., via threads and/or epoxy) to a box end connector of the drill pipe to form at least a portion of the inner shoulder within the box end connector of the drill pipe. At its other end, the drill pipe includes a second generally cylindrical electrical connector substantially electrically insulated from and rigidly coupled to a pin end connector of the drill pipe to form at least a part of an inner shoulder of the pin end connector of the drill pipe. The electrical connectors are hollow cylinders located at opposite ends of the drill pipe and coaxially aligned with the longitudinal axis of the drill pipe to enable drilling fluid to flow through the drill pipe as well as the hollow central portions of the electrical connectors.

Example electrical connectors described herein may have threaded outer diameter surfaces to engage internally threaded surfaces of the ends of the drill pipe. Thus, when the electrical connectors are threaded into the ends of the drill pipe, the connectors are rigidly coupled (i.e., do not move) relative to the drill pipe. To substantially electrically insulate the first and second electrical connectors from the body of the drill pipe, surfaces of the electrical connectors that are to engage the drill pipe (e.g., the threaded outer surfaces) may be coated with a ceramic material prior to coupling the electrical connectors to the ends of the drill pipe. The example electrical connectors described herein may be initially sized or configured so that after they have been coupled or installed in the drill pipe ends, the connectors are machined or otherwise modified so that the electrical connector at the box end of the drill pipe forms at least part of the inner shoulder and the electrical connector at the pin end of the drill pipe forms at least part of an inner shoulder of the pin portion. For example, the electrical connector at the box end of the drill pipe may be machined to be substantially flush with the inner shoulder of the drill pipe body.

The solid (e.g., metal-to-metal) electrical connections provided by examples of wired drill pipe described herein are particularly advantageous because they may be re-cut, re-machined, or re-surfaced multiple times in a manner similar to the manner in which conventional double-shouldered drill pipe is re-cut. Further, in the case where the electrical connectors are threadably engaged in the drill pipe ends (e.g., as opposed to being fixed in place using epoxy, welding, and/or other permanent fastening techniques), the electrical connectors may be easily removed and replaced as needed (e.g., if the connectors are irreparably damaged, can no longer be re-cut or re-machined, etc.). As a result, the example wired drill pipe described herein may provide extended service life compared to other wired drill pipe having electrical contacts employing moving parts and the like.

In some examples of wired drill pipe described herein, an electrical conductor such as a wire or an electrically conductive expanded sleeve extends along the length of and adjacent to an inner wall of the drill pipe. This electrical conductor is substantially electrically insulated from the drill pipe and the ends of the electrical conductor are electrically connected to the first and second electrical connectors. As a result, the first and second electrical connectors and the electrical conductor extending along the length of the drill pipe section form the second or internal electrical path that is substantially electrically insulated from the first electrical path (e.g., external path) through the drill pipe. Where the electrical conductor is implemented as an electrically conductive expanded sleeve or liner, the electrical conductor may be slotted or otherwise perforated or configured to facilitate expansion of the sleeve or liner inside the drill pipe. In other examples, the electrically conductive sleeve or liner may not have any openings in its surface and may be circumferentially sealed at its ends to the inner surfaces of the electrical connectors to provide a hermetic barrier between fluid (e.g., drilling fluid) in the drill pipe and the inner wall of the drill pipe to prevent or inhibit the ingress of mud or other contaminants into and/or corrosion of the interior of the drill pipe.

Thus, when one or more of the example drill pipe sections described herein are threaded together to form a drill string, the outer shoulders of the drill pipe sections contact each other to form an electrical connection along the first electrical path through the drill pipe sections (e.g., an external path) and the inner shoulders of the box and pin portions contact each other directly to form electrical connections along the second electrical path (e.g., an internal path) through the drill pipe sections so that the second electrical path is substantially electrically insulated from the first electrical path. The absence of any moving parts in the example double-shouldered drill pipe described herein results high-reliability conductive electrical connections between drill pipe sections that are capable of conveying data at a relatively high rate. Further, the double-shouldered geometry of the example wired drill pipe described herein can be employed advantageously in applications involving high torque such as, for example, drilling operations in deviated wells. Still further, with the example wired drill pipe described herein, the electrical connectors are configured to be part of the inner shoulders and/or pin portions of the drill pipe in a manner that facilitates re-cutting, re-machining, or re-surfacing of the drill pipe and/or replacement of the electrical connectors to increase the service life of the drill pipe.

In other examples, the electrical connectors described herein may be configured to provide multiple electrical paths or connections in addition to the electrical path through the body of the drill pipe (e.g., the first electrical path). In particular, each of the electrical connectors may provide multiple conductive portions that are electrically insulated from one another via a ceramic insulation, epoxy, or the like. More specifically, in one example, each of the electrical connectors is ring-shaped and is composed of multiple concentric ring-shaped electrical contacts separated by insulation. Thus, when such electrical connectors are used in mating box and pin end connectors of drill pipe, electrical paths may be formed through mating pairs of the concentric rings.

In still other examples, each of the ring-shaped electrical connectors may provide multiple, electrical paths or connections that are circumferentially spaced about the connectors. In particular, multiple electrical connections may be formed by radially dividing the ring-shaped electrical connectors into a plurality of electrical paths that are electrically insulated from one another. In these examples, one of the electrical connectors of a mating pair of connectors (e.g., mating pin and box end connectors) may be configured to have electrical contacts that extend over a portion of the circumference (e.g., 10 degrees) of the ring-shaped connector that is substantially smaller than the portion of the circumference over which the electrical contacts of the mating ring-shaped connector extend (e.g., 160 degrees). In this manner, proper contact between the electrical paths or contacts of the mating pin and box end electrical connectors can be maintained (e.g., shorting across contacts can be prevented) despite variations in the torque used to fit together drill pipe sections, manufacturing tolerances, etc.

In this disclosure, the terms "threaded coupling" or "threaded coupler" are used to mean the threads at one end of a pipe segment that are used in conjunction with threads on an adjacent pipe segment to mechanically couple the pipe segments. A "box connector" and an "pin connector" may be specific types of threaded couplings. The term "electrical connector" is used to mean any device, that when used in connection with an electrical connector in an adjacent pipe segment, may be used to pass electrical signals and/or power. An "electrical contact" is used to describe a point where a galvanic connection may be made with a corresponding electrical contact. Thus, the term "electrical connector" may be broader by including both electrical contacts, as well as inductive, capacitive, and other types of electrical connectors.

FIG. 1 illustrates a drilling rig and drill string that may employ the example conductive wired drill pipe described herein. As shown in FIG. 1, a platform and derrick assembly 100 is positioned over a borehole 102, which penetrates a subsurface formation F. A drill string 104 is suspended within the borehole 102 and includes a drill bit 106 at its lower end. The drill string 104 is rotated by a rotary table 108, energized by means not shown, which engages a kelly 110 at the upper end of the drill string 104. The drill string 104 is suspended from a hook 112, attached to a traveling block (not shown), through the kelly 110 and a rotary swivel 114, which permits rotation of the drill string 104 relative to the hook 112.

The drill string 104 further includes a bottom hole assembly (BHA) 126 disposed near the drill bit 106. The BHA 126 may include capabilities for measuring, processing, and storing information, as well as for communicating with the surface (e.g., with MWD/LWD tools). An example of a communications apparatus that may be used in a BHA is described in detail in U.S. Pat. No. 5,339,037.

The communication signal from the BHA 126 may be received at the surface by a communications transceiver 128, which is coupled a surface computer 132. The surface system may further include a transmitting system 136 to communicate with the downhole instruments (e.g., one or more devices in the BHA 126). The communication link between the downhole instruments and the surface system may comprise, among other things, a drill string telemetry system that comprises a plurality of wired drill pipe (WDP) joints or sections 138.

As an alternative to a rotary table 108, The drill string 104 may otherwise employ a well-known top-drive configuration that uses a power swivel to rotate the drill string. Those with ordinary skill in the art will also appreciate that sliding drilling operations may otherwise be conducted with the use of a well-known Moineau-type mud motor that converts hydraulic energy from the drilling mud 116 pumped from the mud pit 118 down through the drill string 104 into torque for rotating a drill bit. Drilling may also be conducted with well-known rotary-steerable systems. The various aspects of the example wired drill pipe described herein are adapted for use in each of these drilling configurations and are not limited to conventional rotary drilling operations.

In one example, the drill string 104 employs a wired telemetry system in which the WDP sections 138 are interconnected within the drill string 104 to form a communication link (not numbered). As described in greater detail below, the WDP sections 138 may employ example electrical connectors described herein, which are configured to form at least two conductive paths. In some examples, one of the conductive paths is formed by the pipe itself.

Figure 2A:
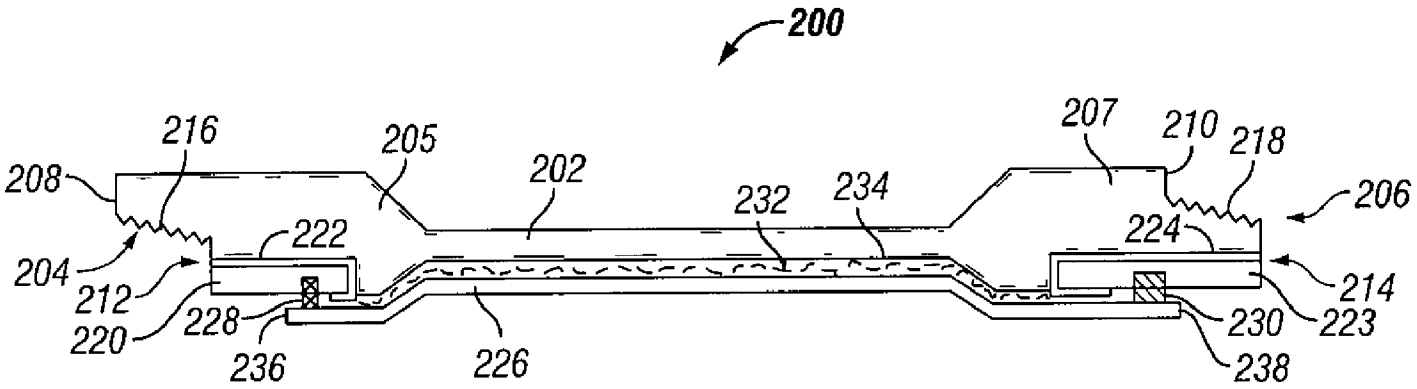
FIG. 2A depicts a cross-sectional view of a portion of an example wired drill pipe that may be used to implement the wired drill pipe sections of FIG. 1.

FIG. 2A depicts a cross-sectional view of a portion of an example wired drill pipe 200 that may be used to implement the WDP sections 138 of FIG. 1. The example wired drill pipe 200 has a generally cylindrical middle portion or body 202 having a double-shouldered configuration at a box end connection or connector 204 and a pin end connection or connector 206. The box and pin end connectors 204 and 206 have respective generally cylindrical bodies 205 and 207, outer shoulders 208 and 210, and inner shoulders 212 and 214. The box and pin end connectors 204 and 206 may be integrally formed in the body 202 of the drill pipe 200 or may be permanently attached via friction welding or the like as is well known in the art. The box and pin end connectors 204 and 206 include respective threads 216 and 218 to enable the example drill pipe 200 to be threadably engaged to other similar sections of wired drill pipe. In particular, the threads 216 of the box end connector 204 are configured to threadably engage threads of a pin end connector (e.g., identical or similar to the threads 218 of the pin end connector 206) of another section of wired drill pipe (e.g., identical or similar to the example wired drill pipe 200). Likewise, the threads 218 of the pin end connector 206 are configured to threadably engage the threads of a box end connector of another section of drill pipe identical or similar to the example wired drill pipe 200.

The box end connector 204 also includes a generally cylindrical or ring-shaped electrical contact 220 that may be rigidly coupled via threaded engagement, epoxy, and/or any other suitable fastening mechanism to the body 205 near the inner shoulder 212. It is noted that a "shoulder" is used herein to describe a device which bears the load of the made-up connection between two pipe joints and provides the resistance to further make-up rotation between the pipe joints. Thus, although an electrical contact may form part of the general shoulder area, in some examples, an electrical contact may not bear any make-up load. It is noted, however, that in other examples, an electrical contact may be used to bear at least some of the make-up load. In this disclosure, it is described as being a separate element from the shoulder, but such description is not intended to exclude examples where the electrical contact bears some or all of the make-up.

In the example shown in FIG. 2A, an insulation material 222 such as, for example, a ceramic or a polymer coating on the electrical contact 220 is disposed between the body 205 and the electrical contact 220 to substantially electrically insulate the electrical contact 220 from the body portions of the drill pipe 202, 205, 207.

The pin end connector 206 includes a generally cylindrical or ring-shaped electrical connection 223 that may be rigidly coupled via threads, epoxy, and/or any other suitable fastening mechanism to the body 207 near the inner shoulder 214. An insulation material 224 such as, for example, a ceramic or a polymer coating on the electrical connector 223 is disposed between the body 207 and the electrical contact 223 to substantially electrically insulate the electrical contact 223 from the body portions of the drill pipe 202, 205, 207.

The example wired drill pipe 200 shown in FIG. 2A also includes an internal electrical conductor 226 that is electrically connected to the electrical contacts 220 and 223 via respective connections 228 and 230, which may be spot welds or any other type of electrically conductive connections. In some examples, the electrical conductor 226 is an electrically conductive sleeve or liner (e.g., made of a metallic material such as stainless steel) that is installed within the drill pipe 200 and expanded to conform at least approximately to the internal dimensions and geometry of the drill pipe 200. In the case where the electrical conductor 226 is a metallic sleeve or the like, a layer of electrically insulating material 232 may be disposed between the electrical conductor 226 and an inner wall 234 of the drill pipe 200 to electrically insulate the conductor 226 therefrom. The electrically insulating material 232 may be, for example an epoxy or polymer, in which case the presence of the material may also serve to inhibit corrosion of the interior of the drill pipe 200, prevent the ingress of drilling fluid and other debris between the conductor 226 and the wall 234 of the drill pipe 200, etc. In some examples, the conductor 226 may be a sleeve-like member having slots or other openings or cuts therethrough to facilitate its expansion within the drill pipe 200. In other examples, the conductor 226 may not have any openings therethrough and may also be circumferentially sealed at its ends 236 and 238 against the contacts 220 and 223 to provide a hermetic seal to prevent contaminants from contacting the inner wall 234 of the drill pipe 200. Various techniques may be employed to provide the conductor 226. Examples of several techniques may be found in published United States Patent Publication 2006/0225926, which is assigned to the assignee of the present application, and which is incorporated by reference herein in its entirety.

Thus, as can be seen from FIG. 2A, two electrical paths are provided by the example wired drill pipe 200. One electrical path extends through the drill pipe drill pipe 200, and a second electrical path extends internally or within the example drill pipe 200 via the conductor 226 and electrical contacts 220 and 223 located adjacent the inner shoulders 212, 214 of the pipe joint 200. Thus, when the example drill pipe 200 is coupled to other similar or identical sections of drill pipe, the inner shoulders 212 and 214 and electrical contacts 220, 223 directly contact or engage the inner shoulders of the other drill pipe to form electrical connections with the respective electrical contacts of the other sections of drill pipe. Further, because the electrical contacts 220 and 223 and the conductor 226 are substantially electrically insulated from the body portions 202, 205, and 207, the second electrical path formed thereby is substantially electrically insulated from the first electrical path.

Figure 2B:
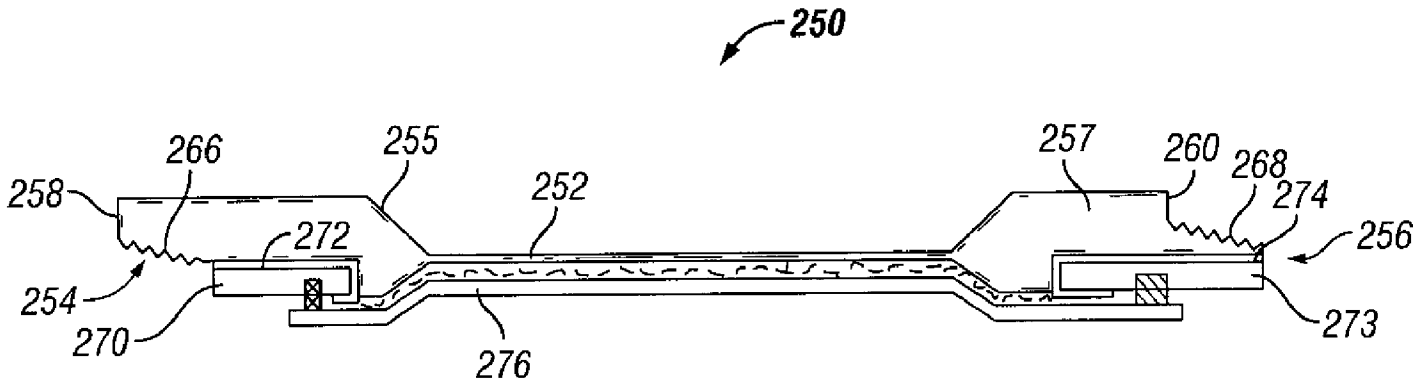
FIG. 2B depicts a cross-sectional view of a portion of another example wired drill pipe that may be used to implement the wired drill pipe sections of FIG. 1.

FIG. 2B depicts a cross-sectional view of a portion of an example wired drill pipe 250 that may be used to implement the WDP sections 138 of FIG. 1. The wired drill pipe section 250 includes a box end 254 that includes threads 266 and a shoulder 258. Similarly, the pin end 256 includes external threads 268 and a shoulder 260. The example wired drill pipe 250 is different from the example wired drill pipe 200 shown in FIG. 2A because the example wired drill pipe 250 in FIG. 2B has a single-shouldered configuration at a box end connection or connector 254 and a pin end connection or connector 256, and not a double-shouldered configuration.

The box end connector 254 includes a generally cylindrical or ring-shaped electrical contact 270 that may be rigidly coupled via threaded engagement, epoxy, and/or any other suitable fastening mechanism to the body 255. In this case, the electrical contact is located in a position where an inner shoulder may be located in a double shouldered connection. It is noted that the electrical connector is not referred to as a shoulder, although the electrical contact may bear at least some of the make-up load.

In the example shown in FIG. 2B, an insulation material 272 such as, for example, a ceramic or a polymer coating on the electrical contact 270 is disposed between the body 255 and the electrical contact 270 to substantially electrically insulate the electrical contact 270 from the body portions of the drill pipe 252, 255, 257.

The pin end connector 256 includes a generally cylindrical or ring-shaped electrical connection 273 that may be rigidly coupled via threads, epoxy, and/or any other suitable fastening mechanism to the body 257. An insulation material 274 such as, for example, a ceramic or a polymer coating on the electrical connector 273 is disposed between the body 257 and the electrical contact 273 to substantially electrically insulate the electrical contact 273 from the body portions of the drill pipe 252, 255, 257.

The example wired drill pipe 250 shown in FIG. 2A also includes an internal electrical conductor 276, substantially as described above with respect to electrical conductor 226, shown in FIG. 2A.

Thus, as can be seen from FIG. 2B, two electrical paths are provided by the example wired drill pipe 250. One electrical path extends through the drill pipe drill pipe 250, and a second electrical path extends internally or within the example drill pipe 250 via the conductor 276 and electrical contacts 270 and 273. Thus, when the example drill pipe 250 is coupled to other similar or identical sections of drill pipe, the electrical contacts 270, 273 directly contact or engage corresponding contacts in the other sections of drill pipe. Further, because the electrical contacts 270 and 273 and the conductor 276 are substantially electrically insulated from the body portions 252, 255, and 257, the second electrical path formed thereby is substantially electrically insulated from the first electrical path.

Figure 3A:
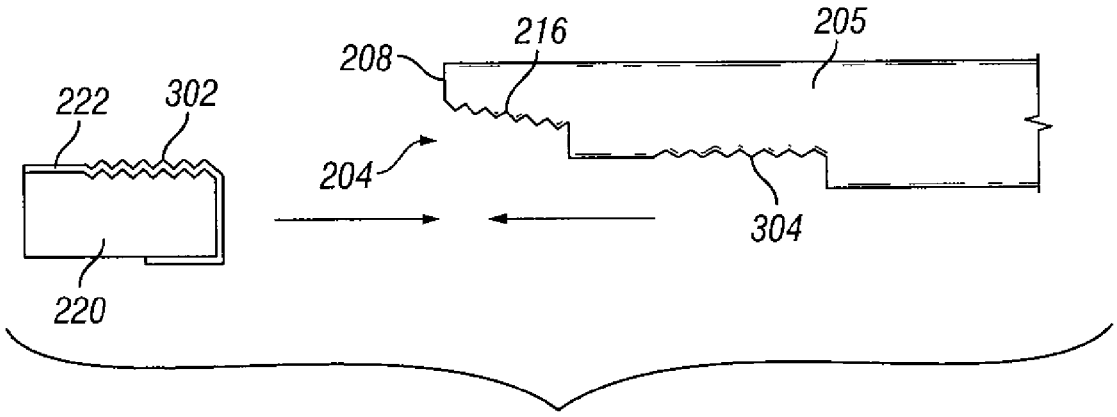
FIGS. 3A, 3B, and 3C depict an example manner in which the electrical connectors of FIG. 2 may be rigidly coupled to the ends of the example drill pipe of FIG. 2.
Figure 3B:
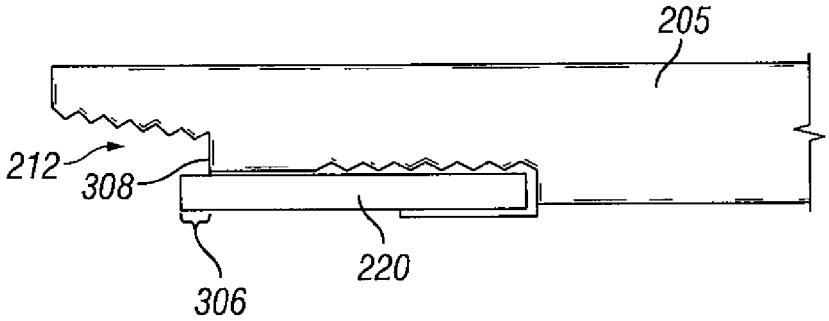
Figure 3C:
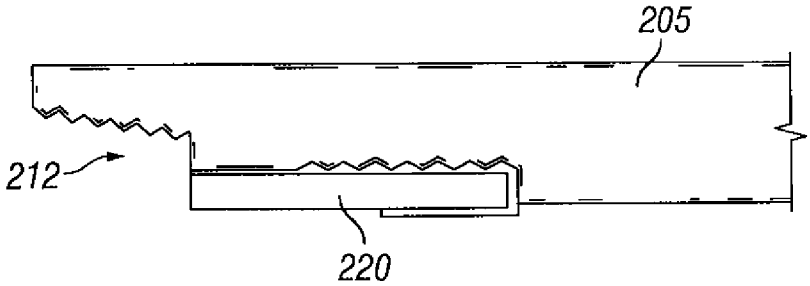

FIGS. 3A, 3B, and 3C depict an example manner in which the electrical contacts 220 and 223 (or 270 and 273) may be rigidly coupled to their respective connector ends 204 and 206 of the example drill pipe 200. In particular, FIGS. 3A-3C depict the box end connector 204 However, the principles shown in these figures may be applied to the pin end connector 206 to provide a similar coupling between the contact 223 and the body 207 of the pin end connector 206. As shown in FIG. 3A, the substantially cylindrical or ring-shaped electrical contact 220 has the coating of insulation (e.g., a ceramic material) 222 applied to the portions of the electrical contact 220 that would otherwise contact the body 205 of the box end connector 204. In this example, an outer portion or surface of the electrical contact 220 includes threads 302 to threadably engage with internal threads 304 of the body 205.

FIG. 3B depicts the electrical contact 220 after it is threadably engaged with the body 205. As can be seen in FIG. 3B, the electrical contact 220 is sized (e.g., has a length or height) such that a portion 306 extends beyond a shoulder 308 of the body 205. This portion 306 is machined or ground down to form the final inner shoulder 212 as shown in FIG. 3C.

While FIGS. 3A-3C depict the use of threads to rigidly couple the electrical contacts 220 and 223 to their respective bodies 205 and 207, a semi-permanent adhesive or sealant or a permanent adhesive and/or other fastening techniques may be used instead of or in addition to threaded engagements such as the threads 302 and 304. However, in the case where a permanent (rather than removable or semi-permanent) coupling is employed, the contacts 220 and 223 may be not easily removed for replacement.

Figure 4:
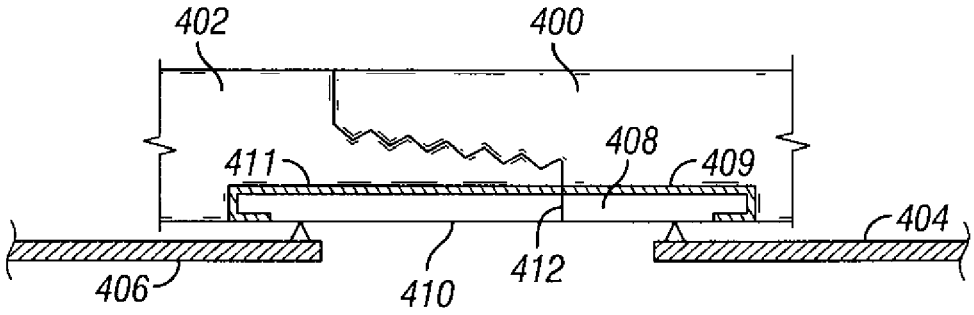
FIG. 4 depicts a cross-sectional view of the manner in which the example wired drill pipe sections described herein may be coupled together.

FIG. 4 depicts a cross-sectional view of the manner in which the example wired drill pipe sections described herein are coupled together. As shown in FIG. 4, a box end connector 400 of a first section of wired drill pipe, which may be similar or identical to the box end connector 204 of FIG. 2, is coupled to a pin end connector 402 of a second section of wired drill pipe. An electrical path extends from a first internal conductor (e.g., a conductive liner) 404 to a second internal conductor 406 (e.g., another conductive liner) through electrical conductors 408 and 410, which are in direct electrical (i.e., conductive) contact at joint 412. As shown in FIG. 4, the contacts 408, 410 are formed as part of the pipe joints, and they are held in place by a layer of insulating material 409, 411. The mating end surfaces of the electrical contacts 410 and 412 may be machined to form the inner shoulders of the end connectors of the drill pipe sections as described above. As a result, the engagement or contact of the inner shoulders may form a metal-to-metal seal that prevents drilling fluid from leaking between the joints of the drill pipe sections.

Figure 5:
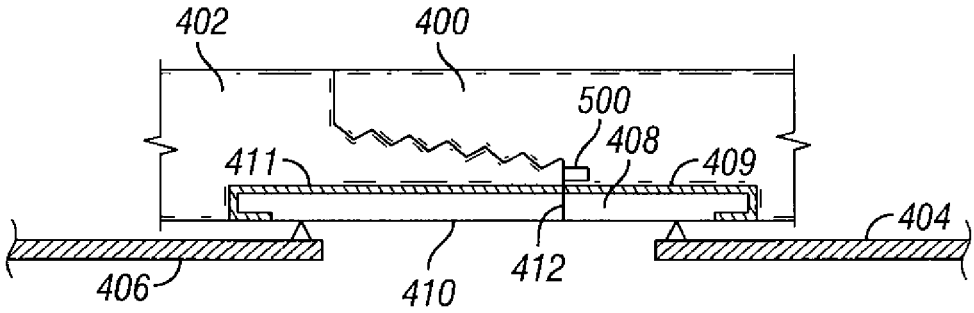
FIG. 5 depicts one manner in which the body of FIG. 4 may be modified to include a circumferential groove or channel in which an o-ring or other similar sealing device may be placed.

In FIG. 5, the body 400 has been modified to include a circumferential groove or channel 500 adjacent the electrical contact 408, in which an o-ring or other similar sealing device may be placed to provide an additional sealing mechanism between the ends of the drill pipe sections. Alternatively, the groove or channel 500 may be left open (i.e., no seal placed therein) to provide a reservoir for pipe dope and to exclude corrosive fluids.

Figure 6:
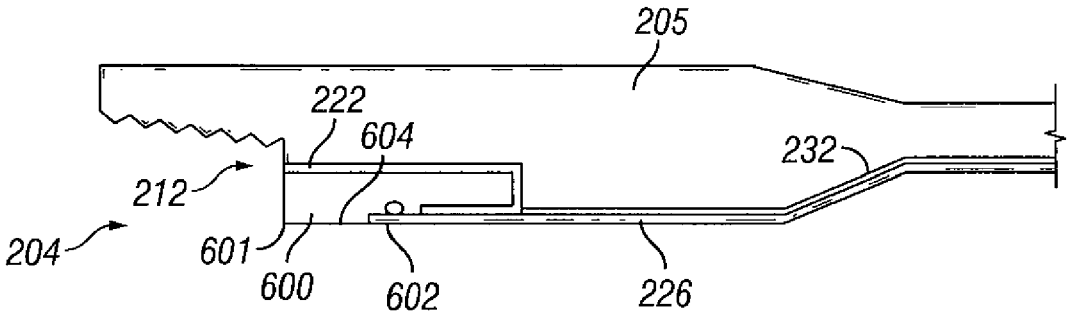
FIG. 6 depicts an example wired drill pipe having an electrical connector in which an inner surface of a liner has been at least partially recessed to maintain a substantially flush engagement of an end of the liner with an adjacent edge of the connector.

FIG. 6 depicts an example having an electrical contact 600 similar to the electrical contact 220, except an inner surface 601 has been at least partially recessed to maintain a substantially flush engagement of an end 602 with an adjacent edge 604 of the contact 600. Such an arrangement provides a smooth transition between the electrical contact 600 and the inner conductor 226 (e.g., a conductive liner) to improve the flow characteristics within the drill pipe sections (e.g., to provide a maximum flow area). To achieve this flush configuration of the conductor 226 and the electrical contact 600, the length of the conductor 226 may be trimmed after it has been formed (e.g., expanded) to fit the inside of the drill pipe.

Figure 7:
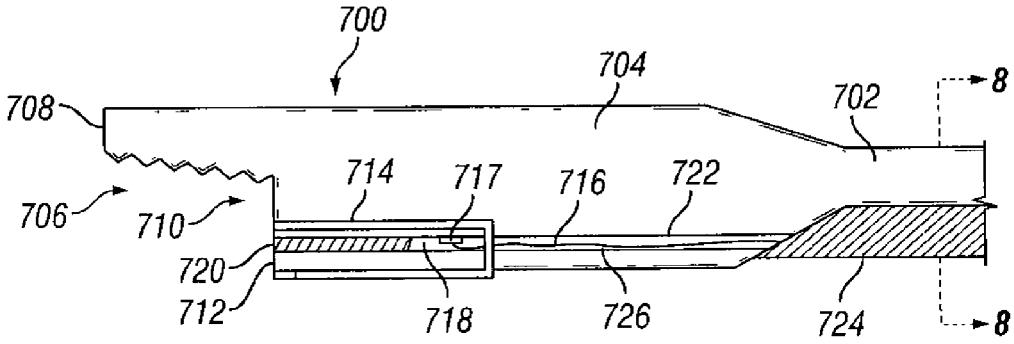
FIGS. 7 and 8 depict another example wired drill pipe that may be used to provide dual electrical connections between and along multiple sections of drill pipe.
Figure 8:
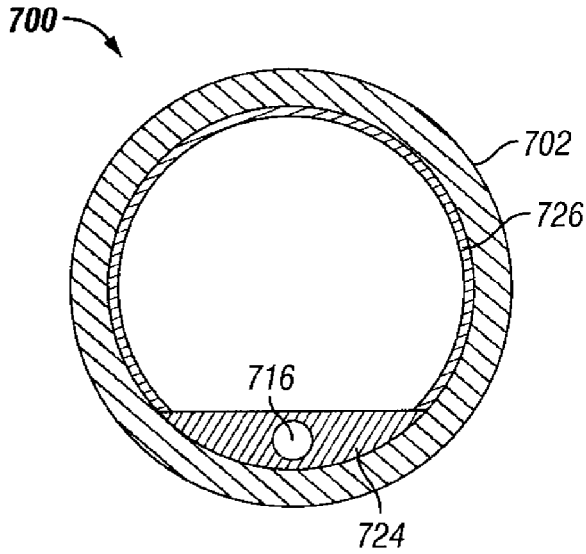

FIGS. 7 and 8 depict another example wired drill pipe 700 that may be used to provide dual electrical connections between and along multiple sections of drill pipe. The example wired drill pipe 700 includes a generally cylindrical middle body portion 702 and a generally cylindrical body 704 that forms a box end connector 706. The box end connector 706 is a double-shouldered configuration similar to that depicted in FIG. 2 and, thus, has an outer shoulder 708 and an inner shoulder 710. Similar to the configuration shown in FIG. 2, the inner shoulder 710 is at least partially formed by a generally cylindrical or ring-shaped electrical contact 712 that is rigidly coupled (e.g., via threads, epoxy, etc.) to the body 704. The electrical contact 712 is made of a conductive material (e.g., a metal) and is configured to make direct electrical contact with a complementary inner shoulder of a pin end connector (not shown), which may be similar in construction to the electrical contact 712. Also, similar to the electrical contact 220 of FIG. 2, the electrical contact 712 is substantially electrically insulated from the body 704 via a layer of insulation 714, which may be implemented using a ceramic coating, a polymer, etc.

In contrast to the wired drill pipe 200 in FIG. 2, the electrical contact 712 is electrically coupled along the body 702 of the wired drill pipe 700 via a cable or wire 716 (rather than an expanded sleeve or liner). The cable or wire 716 is electrically connected (e.g., spot welded, brazed, etc.) at a connection 717 to the electrical contact 712 inside an opening (e.g., a through hole) 718 in the contact 712. A portion of the opening 718 may be filled with an epoxy or other filler 720 to seal the opening from the internal environment of the drill pipe 700 (e.g., to prevent water, mud, etc. from contaminating the connection 717 and/or the cable or wire 716). The cable or wire 716 runs in a channel 722 that passes through the body 704 to enable the wire or cable 716 to run or extend along the length of the drill pipe 700. The example wired drill pipe 700 may also include an electrically insulating layer 724, which may be made of an epoxy, composite material, or any other suitable material or combination of materials that serve to encapsulate and protect the wire or cable 716 from the internal environment of the drill pipe 700 (e.g., drilling fluid). Additionally, the example wired drill pipe 700 may include an electrically insulating coating or layer 726 to protect the inner wall of the drill pipe 700 from corrosion. While a box end connector is depicted in the example of FIGS. 7 and 8, the configuration depicted therein may also be applied to a pin end connector (e.g., the pin end connector 206 of FIG. 2) in a similar manner.

The examples shown in FIGS. 2A-7 enable a threaded connection to be machined following use to improve the mechanical performance of the threaded connection. It is typical in the art to machine a threaded connection after the connection has been through several make and breaks (process of making-up the connection, or connecting two unconnected pipes, and breaking the connection, or disconnecting two connected pipes), which may cause wear and tear on the threads, thereby decreasing the performance of the connection. When the pipe section to be machined or recut is a wired drill pipe, it may be desirable to machine the pin and box end connectors, without degrading or otherwise effecting the performance of the electrical connectors. By machining the electrical contacts described above along with the rest of the threaded connection, the resulting threaded connection may include electrical contacts that work in the same manner as before. That is, the removal of material from the threaded connection may be done in a typical manner, and the resulting electrical contact will still enable an electrical connection with an adjacent drill pipe, when connected.

Figure 9:
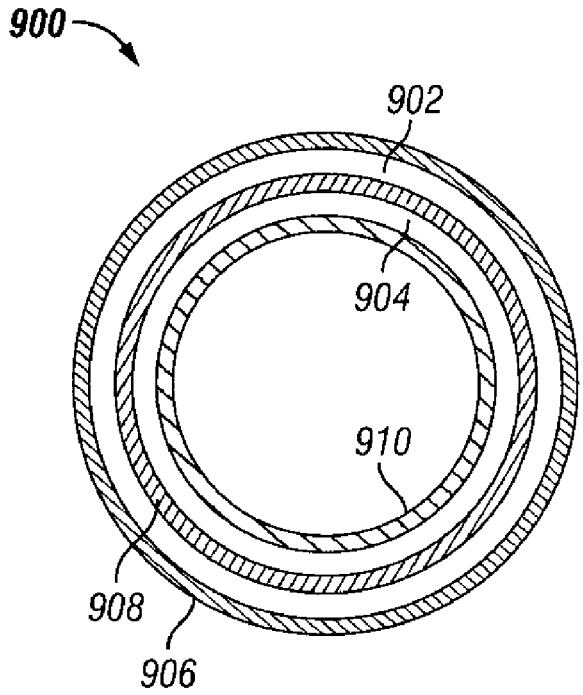
FIGS. 9 and 10 depict end views of two examples of alternative cylindrical electrical connectors that may be used with the example wired drill pipe described herein to provide two or more internal electrical paths in a wired drill pipe.
Figure 10:
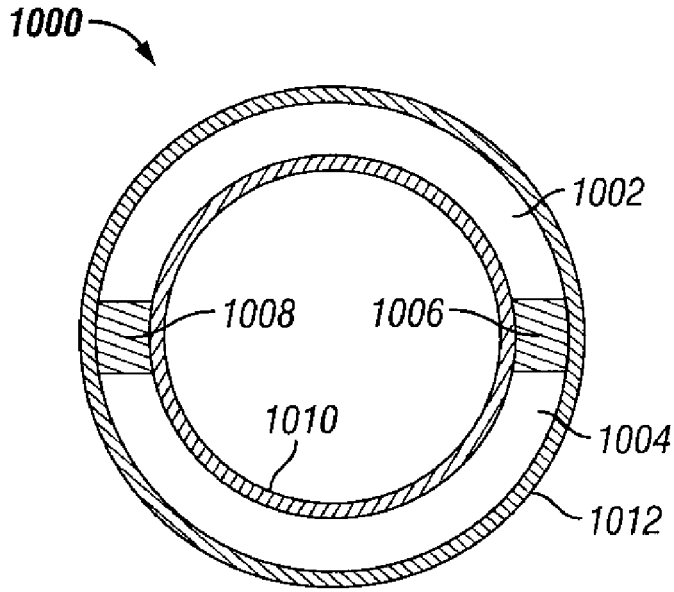

FIGS. 9 and 10 depict end views of two alternative cylindrical electrical contacts 900 and 1000 that may be used with the example wired drill pipe described herein to provide two or more internal electrical paths in a wired drill pipe. For example, the electrical contacts 900 and 1000 may be used instead of the electrical contact 220 of FIG. 2 to provide two internal electrical paths and optionally one electrical path along the exterior of the drill pipe for a total of up to three electrical paths. In the example of FIG. 9, the electrical contact 900 includes concentric electrically conductive cylinders 902 and 904 that are substantially electrically insulated from each other and the body of the drill pipe in which the contact is installed by insulation layers 906, 908, and 910.

In the example of FIG. 10, the electrical contact 1000 has opposing semi-circular electrical contacts 1002 and 1004 that are insulated from each other and the body of the drill pipe in which the contact 1000 is installed by insulation layers 1006, 1008, 1010, and 1012. Opposing semi-circular contacts describes electrical contacts that form a portion of a circle, and lie in the same circle as another opposing electrical. In the example shown in FIG. 10, the opposing semi-circular contacts 1002, 1004 each form about half of a circle. Each may form somewhat less than a half circle, so that there is room for the appropriate insulation 1006, 1008 between the contacts.

Figure 11:
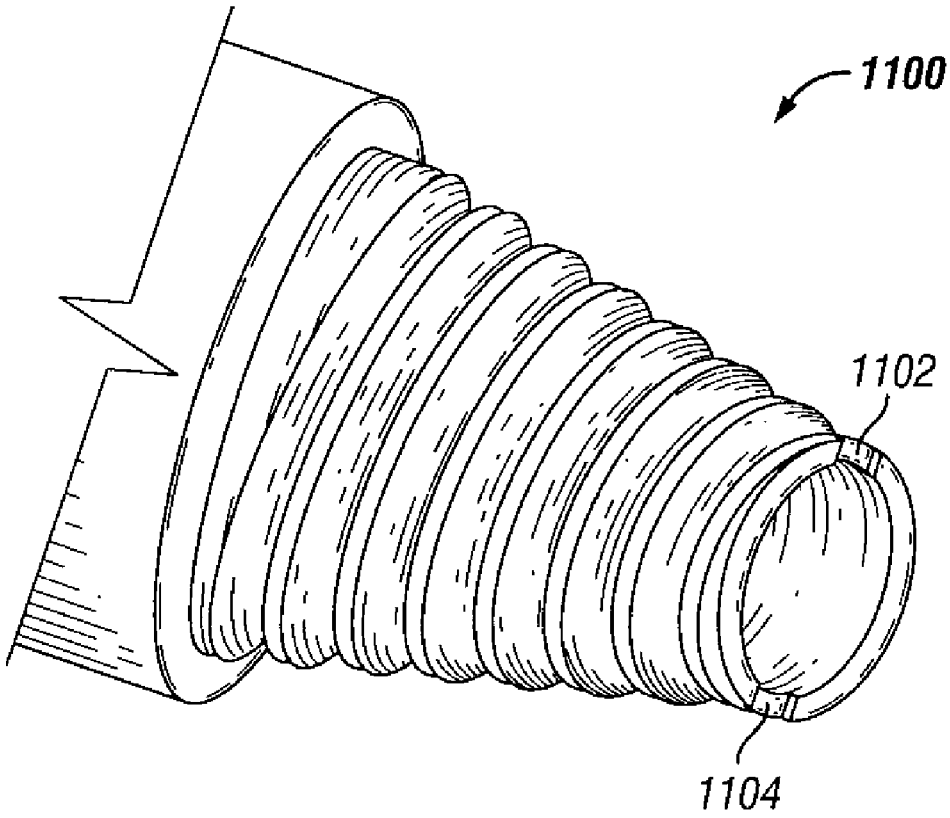
FIG. 11 depicts an example pin connector with multiple contacts that may be used to mate with the connector depicted in FIG. 10.

Example contacts 1102, 1104 that may mate with the electrical contact 1000 in FIG. 10 are shown in FIG. 1. FIG. 11 shown a pin connector 1100 with two protruding contacts 1102, 1104. The contacts 1102, 1104 have a circumferential width that is smaller than the circumferential gap between the electrical contacts 1002, 1004 shown in FIG. 10. In this manner, there can be no shorting between the contacts 1002, 1004 from the corresponding contact (1102, 1104 in FIG. 1) when the adjacent pipe sections are connected.

The contacts 1102, 1104 may be flush with the inner shoulder, or they may protrude from the shoulder. The contacts 1102, 1104 are shown diametrically opposed, which will ensure that while one electrical contact is engaged with one of a pair of opposed semi-circular contacts (see, e.g., FIG. 10), the other electrical contact will be engaged with the other one of the pair of opposed semi-circular contacts.

It is noted that although the above examples relate to a wired drill pipe, the contacts may also be applied to wired jars, wired heavy-weight drill pipe, drill collars, repeaters, downhole tools, and other equipment.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A pipe segment, comprising:

a generally cylindrical body having a pin end connector at a first end and a box end connector at a second end;

a generally cylindrical first electrical contact coupled to the cylindrical body proximate the pin end connector, wherein the first electrical contact is substantially electrically insulated from the cylindrical body and is configured to make electrical contact with a corresponding electrical contact in a first adjacent pipe segment when the pipe segment is coupled to the first adjacent pipe segment;

a generally cylindrical second electrical contact coupled to the cylindrical body proximate the box end connector, wherein the second electrical contact is substantially electrically insulated from the cylindrical body and is configured to make electrical contact with a corresponding electrical contact in a second adjacent pipe segment when the pipe segment is coupled to the second adjacent pipe segment; and a first conductor connected to the first and second electrical contacts and extending therebetween, the conductor substantially electrically insulated from the cylindrical body, wherein the pin end connector and the box end connector are configured to be machined without effecting the configuration of the first and second electrical contacts to make an electrical connection with electrical contacts in first and second adjacent pipe segments.

2. The pipe segment of claim 1, wherein the first electrical contact and the second electrical contact are coupled to the cylindrical body by mating threads.

3. The pipe segment of claim 1, further comprising:

a circumferential groove in one or more a shoulder in the pin end connector and a shoulder in the box end connector; and a sealing device disposed in the circumferential groove.

4. The pipe segment of claim 1, further comprising an insulating material, and wherein the conductor is encapsulated by the insulating material over at least a portion of a distance between the pin end connector and the box end connector.

5. The pipe segment of claim 1, further comprising:

a generally cylindrical third electrical contact coupled to the cylindrical body proximate the pin end connector, wherein the third electrical contact is substantially electrically insulated from the cylindrical body and the first electrical connector and is configured to make electrical contact with a corresponding electrical contact in the first adjacent pipe segment when the pipe segment is coupled to the first adjacent pipe segment;

a generally cylindrical fourth electrical contact coupled to the cylindrical body proximate the box end connector, wherein the fourth electrical contact is substantially electrically insulated from the cylindrical body and the second electrical contact and is configured to make electrical contact with a corresponding electrical contact in the second adjacent pipe segment when the pipe segment is coupled to the second adjacent pipe segment; and a second conductor connected to the third and fourth electrical contacts and extending therebetween, the conductor substantially electrically insulated from the cylindrical body and the first conductor.

6. The pipe segment of claim 1, wherein:

the first electrical contact is disposed proximate an inner shoulder of the pin end connector; and the second electrical contact is disposed proximate a an inner shoulder of the box end connection.

7. The pipe segment of claim 6, wherein the first and second electrical contacts are further configured to bear at least a portion of a make-up load.

8. The pipe segment of claim 1, wherein the first electrical contact and the second electrical contact are coupled to the cylindrical body by an epoxy.

9. The pipe segment of claim 8, wherein the insulation comprises a ceramic coating applied to one or more of the threads.

10. A method of forming a wired drill pipe, comprising:

coupling a generally cylindrical first electrical contact to a cylindrical body proximate a pin end connector so that an end of the first contact extends beyond a shoulder in the pin end connector, wherein the first electrical contact is substantially electrically insulated from the cylindrical body;

coupling a generally cylindrical second electrical contact to the cylindrical body proximate the box end connector so that an end of the second contact extends beyond a shoulder in the box end connector, wherein the second electrical contact is substantially electrically insulated from the cylindrical body;

machining the first electrical contact to form a inner pin shoulder; and machining the second electrical contact to form an inner box shoulder.

11. The method of claim 10 further comprising:

determining a wear status of at least one of the end connectors of the wired drill pipe;

if the wear status exceeds a predetermined threshold, machining the at least one end connector to restore mechanical properties, substantially without affecting the electrical properties of the wired drill pipe.

12. The method of claim 11, wherein machining the at least one end connector comprises machining at least one of the first and second electrical contacts.

13. A pipe segment, comprising:

a tubular section;

a pin end connector at a first end of the tubular section;

a box end connector at a second end of the tubular section;

a first contact portion, disposed in one of the pin end connector and the box end connector, the first contact portion comprising opposing semi-circular contacts that are insulated from each other; and a second contact portion, disposed in the other of the pin end connection and the box end connection, the second contact portion comprising a first electrical contact element and a second electrical contact element, where the first and second electrical contact elements are configured to make electrical contact with corresponding opposing semi-circular contacts in an end connector of an adjacent pipe segment, and wherein the first and second electrical contact elements are sized such that they cannot make electrical contact with both electrical contacts of the opposing semi-circular contacts in the end connector of the adjacent pipe segment.

* * * * *